US005418601A

United States Patent [19]

Fujisawa et al.

[11] Patent Number: 5,418,601

[45] Date of Patent: May 23, 1995

[54] CLAMSHELL-TYPE IMAGE FORMING APPARATUS HAVING ENGAGING HOOK AND SLIDING LOCK MEMBER

[75] Inventors: Shuji Fujisawa; Takao Besshi, both of Osaka, Japan

[73] Assignee: Mita Industrial Co., Ltd., Osaka, Japan

[21] Appl. No.: 179,063

[22] Filed: Jan. 10, 1994

[30] Foreign Application Priority Data

Jan. 8, 1993 [JP] Japan ..... 5-002026

[51] Int. Cl.[6] ..... G03G 15/00

[52] U.S. Cl. ..... 355/200; 292/106

[58] Field of Search ..... 355/200, 210, 211, 212; 292/31, 106, 120

[56] References Cited

U.S. PATENT DOCUMENTS 4,432,639 2/1984 Saitou et al. ..... 355/230
4,705,384 11/1987 Mizutani et al. ..... 355/200
4,789,876 12/1988 Miyai et al. ..... 355/200
4,908,659 5/1990 Ishii et al. ..... 355/200
5,041,872 8/1991 Nukaya et al. ..... 355/200
5,168,308 12/1992 Hiraike et al. ..... 355/211
5,285,240 2/1994 Kinoshita et al. ..... 355/200

*Primary Examiner*—Robert B. Beatty
*Attorney, Agent, or Firm*—Beveridge, DeGrandi, Weilacher & Young

[57] ABSTRACT

In a clamshell-type image forming apparatus in which the upper unit is rotatably openably connected to the lower unit and in which the upper unit is biased in the opening direction by a biasing member, a hook is disposed at the upper unit and an engagement member is disposed at the lower unit for preventing the upper unit from being opened when the engagement member is engaged with the hook. The engagement of a lock member with the hook in association with the closing operation of a front cover, prevents the hook from being rotated. The disengagement of the lock member from the hook in association with the opening operation of the front cover, allows the hook to be rotated.

5 Claims, 3 Drawing Sheets

CLAMSHELL-TYPE IMAGE FORMING APPARATUS HAVING ENGAGING HOOK AND SLIDING LOCK MEMBER

BACKGROUND OF THE INVENTION

The present invention relates to an image forming apparatus such as a copying machine, a laser beam printer, a facsimile or the like.

Conventionally, there has been proposed, as an example of the image forming apparatus above-mentioned, a clamshell-type image forming apparatus having the main body divided into two units, i.e., an upper unit and a lower unit, which are disposed such that a paper delivery passage is formed therebetween and in which the upper unit is rotatably and openably connected to the lower unit.

In this clamshell-type image forming apparatus, the upper unit is normally biased in the opening direction by a biasing member such as a spring or the like. Accordingly, when the upper unit is opened, the upper unit is prevented from being downwardly rotated. Further, a rotatably openable front cover is disposed at the fronts of the upper and lower units for facilitating a jam processing or maintenance. To maintain the upper unit as closed, the upper unit has a hook to be engaged with an engagement member disposed at the lower unit. Generally, this hook is rotatable around an axis parallel to the axis of rotation of the upper unit.

According to the arrangement above-mentioned, when the image forming apparatus is vibrated in the course of transportation or the like, the hook may be rotated and disengaged from the engagement member of the lower unit. If the hook is disengaged from the engagement member of the lower unit, this disadvantageously causes the upper unit to be unexpectedly opened since the upper unit is biased in the opening direction by the biasing member. Accordingly, side plates forming portions of the frames of the upper and lower units are connected to each other with bolts or the like, or there is additionally disposed a whirl-stop member for preventing the hook from being rotated, thus preventing the upper unit from being unexpectedly opened.

In a small copying machine particularly for a domestic use, however, the user may fail to take out such bolts or whirl-stop member although the bolts or whirl-stop member should be taken out. In such a case, even though the user wants to open the upper unit at the time of a jam processing or the like, the upper unit cannot be opened. Accordingly, the user may misunderstand the situation and think that the copying machine is out of order.

After being taken out from the image forming apparatus, such bolts or whirl-stop member are generally thrown away. Accordingly, when moving the image forming apparatus once installed at a predetermined place, to another place, it is not possible to prevent the upper unit from being unexpectedly opened due to vibration.

OBJECT AND SUMMARY OF THE INVENTION

It is an object of the present invention to provide an image forming apparatus capable of preventing the upper unit from being unexpectedly opened with no special operation required for allowing the hook to be rotated.

It is another object of the present invention to provide an image forming apparatus capable of preventing the upper unit from being unexpectedly opened irrespectively of before and after the installation of the image forming apparatus.

To achieve the objects above-mentioned, the present invention provides a clamshell-type image forming apparatus in which the upper unit is rotatably openably connected to the lower unit, in which the upper unit is biased in the opening direction by a biasing member and in which a rotatably openable front cover is disposed at the fronts of the upper and lower units, the image forming apparatus comprising: a hook disposed at one of the upper and lower units and rotatably operable around an axis parallel to the axis of rotation of the upper unit; an engagement member disposed at the other of the upper and lower units and adapted to be engaged with the hook, thereby to prevent the upper unit from being opened; a spring for biasing the hook in such a direction that the hook is engaged with the engagement member; and a lock member so disposed as to be reciprocated along an axis parallel to the axis of rotation of the hook, the lock member being adapted to restrain the rotation of the hook engaged with the engagement member when the lock member is moved in the going direction in association with the closing operation of the front cover, and adapted to allow the rotation of the hook when the lock member is moved in the returning direction in association with the opening operation of the front cover.

According to the image forming apparatus having the arrangement above-mentioned, when the front cover which has been opened for a paper jam processing or the like, is closed by the operator, the lock member is moved in the going direction. This prevents the rotation of the hook engaged with the engagement member, thus preventing the upper unit from being unexpectedly opened. On the other hand, when the front cover which has been closed, is opened by the operator, the lock member is moved in the returning direction. This allows the rotation of the hook. Accordingly, when the hook is rotated and disengaged from the engagement member, the upper unit can be opened.

Preferably, the lock member is attached to a safety switch operating lever adapted to be reciprocated along the axis of rotation of the hook in association with the opening/closing operation of the front cover. According to the arrangement above-mentioned, it is not required to dispose, on the image forming apparatus, a mechanism for supporting the lock member such that the lock member can be reciprocated. This simplifies the structure of the image forming apparatus.

According to the present invention, the image forming apparatus may be arranged such that the hook is disposed at each of two positions at the forward and rearward sides thereof, that these hooks are integrally rotatably connected to each other, and that the lock member is adapted to be engaged with either one of the hooks to prevent the hooks from being rotated. In such an arrangement, opening the upper unit by the biasing member can be securely prevented at the two positions of the image forming apparatus at the forward and rearward sides thereof. Further, by engaging the lock member with only one of the two hooks, the rotation of the other hook can also be prevented. It is therefore not required to dispose the lock member for each of the hooks.

Preferably, the hooks are attached to the safety switch operating lever. In such an arrangement, the image forming apparatus is not required to have a mechanism for rotatably attaching the hooks. This simplifies the structure of the image forming apparatus.

The lock member may include a lock pin to be engaged with a hook. In such an arrangement, when the lock pin is engaged with the hook, this prevents the rotation of the hook engaged with the engagement member.

DETAILED DESCRIPTION OF THE PREFERRED EMBODIMENTS

The following description will discuss in detail the present invention with reference to the attached drawings showing a preferred embodiment thereof.

Figure 3:
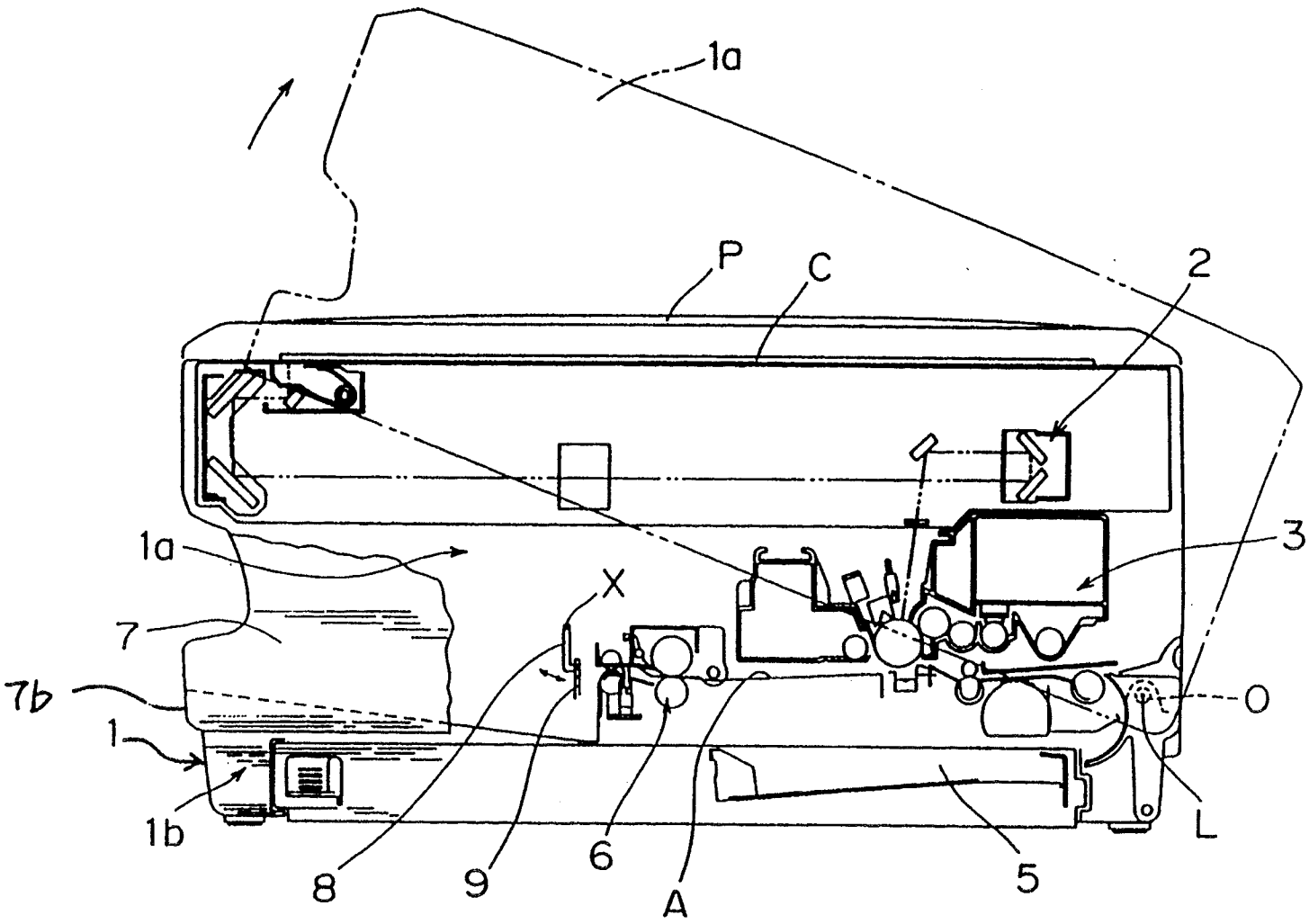
FIG. 3 is a schematic view of the inside arrangement of a copying machine as an example of the image forming apparatus.

FIG. 3 is a schematic view of the inside arrangement of a copying machine serving as the image forming apparatus of the present invention. In the copying machine, the main body 1 is divided into two units, i.e., an upper unit 1*a* and a lower unit 1*b*, which are disposed such that a paper delivery passage A is formed therebetween, and in which the upper unit 1*a* is rotatably connected to the lower unit 1*b* through a connection shaft 0.

Disposed on the top surface of the upper unit 1*a* are a document holding plate P and a contact glass C, under which disposed is an optical unit 2 for illuminating and scanning a document set on the contact glass C. Disposed under the optical unit 2 is an image forming unit 3 in which an electrostatic latent image corresonding to a document image is formed by illumination light of the optical unit 2 and in which the latent image is then converted into a toner image, which is then transferred to paper delivered along the paper delivery passage A.

The upper unit 1*a* is biased normally in the opening direction by a biasing member such as a torsion bar, a coil spring or the like disposed along the connection shaft 0. This prevents the upper unit 1*a* as opened from being downwardly rotated. Disposed in the lower unit 1*b* is a paper feeding unit 5 for feeding paper to the paper delivery passage A. A fixing unit 6 for fixing the toner image transferred onto paper, is disposed as extending over the lower unit 1*b*.

In the copying machine having the arrangement above-mentioned, a front cover 7 is disposed at the front portion of the units 1*a*, 1*b* for covering an open space therebetween. The front cover 7 is openable as rotated around the bottom 7*b* thereof. The upper unit 1*a* has hooks 8 to be operated as rotated around an axis X parallel to the axis of rotation L of the upper unit 1*a*. The lower unit 1*b* has engagement members 9 adapted to be engaged with the hooks 8 to prevent the upper unit 1*a* from being opened by the biasing force of the biasing member.

Figure 1:
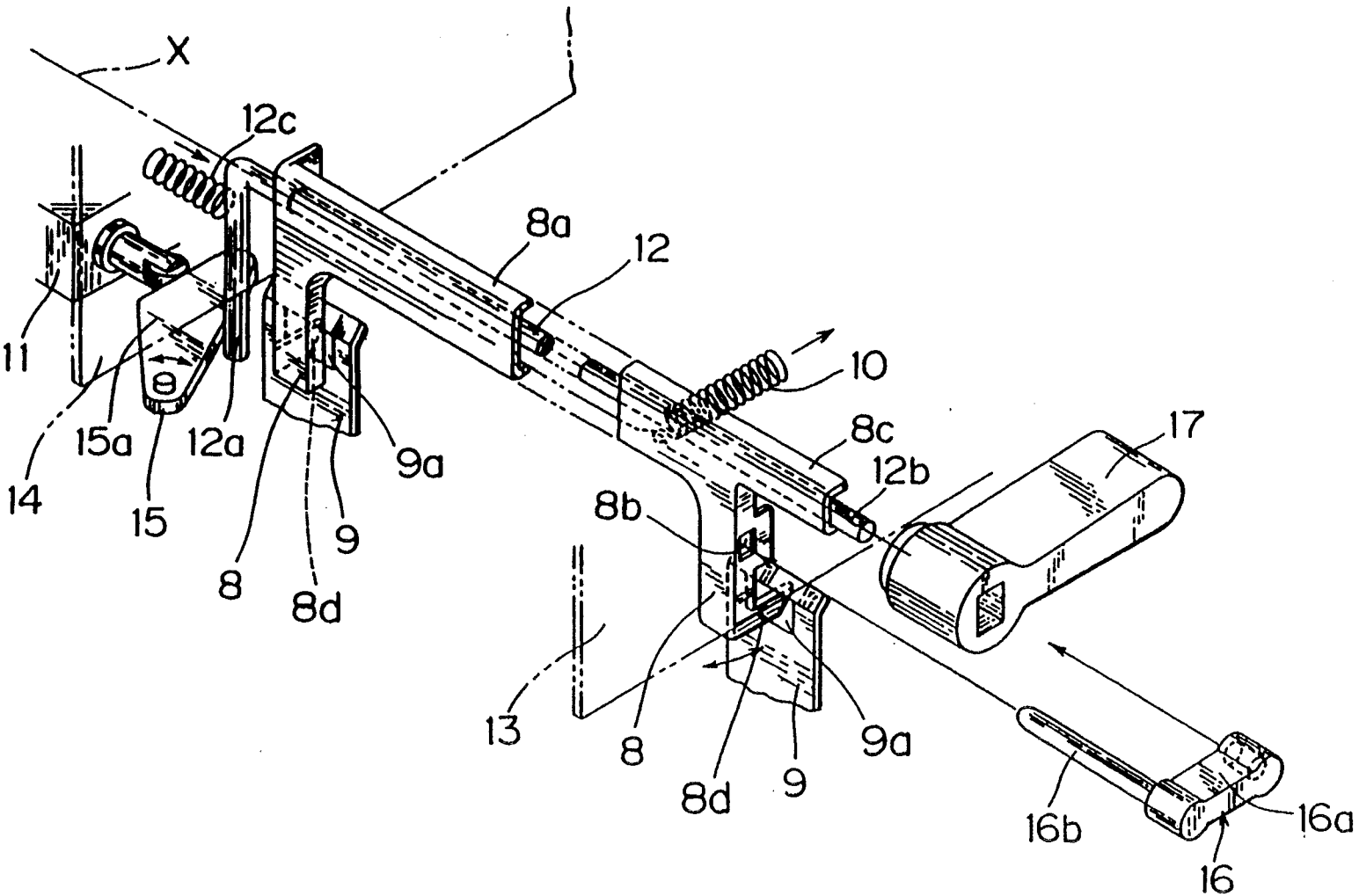
FIG. 1 is a perspective view of main portions of an embodiment of the image forming apparatus according to the present invention.

As shown in FIG. 1, the hooks 8 are disposed in the form of a pair at the forward and rearward sides of the upper unit 1*a*. The engagement members 9 to be engaged with the hooks 8 are disposed, correspondingly to the hooks 8, in the form of a pair at the forward and rearward sides of the lower unit 1*b*. It is therefore possible to securely prevent the upper unit 1*a* from being opened. One hook 8 and the other hook 8 are connected to each other by a transversely extending frame 8*a* such that the hooks 8 can be integrally rotated. The hooks 8 and the frame 8*a* are integrally formed by pressing metal. The hooks 8 are rotatably attached to a safety switch operating lever 12 for operating a safety switch 11, and normally biased by a coil spring 10 in such a direction that the hooks 8 are engaged with the engagement members 9. When pawls 8*d* formed at the lower portions of the hooks 8 are inserted in holes 9*a* formed in the engagement members 9, the hooks 8 are engaged with the engagement members 9.

In association with the opening/closing operation of the front cover 7, the safety switch operating lever 12 is reciprocated to operate the safety switch 11. The safety switch operating lever 12 is slidably inserted into a pair of side plates 13, 14 disposed at the forward and rearward sides of the upper unit 1*a*. The safety switch operating lever 12 is normally biased toward the front cover 7 by a compression spring 12*c* disposed at the rearward side of the lever 12. The safety switch operating lever 12 is adapted to be rearwardly moved in the going or a first direction when the front cover 7 is closed, and forwardly moved in a second or returning direction when the front cover 7 is opened. The rear end 12*a* of the safety switch operating lever 12 is downwardly turned and engaged with an operating mechanism 15 for pushingly operating the safety switch 11. As forwardly moved, the safety switch operating lever 12 rotates a pushing cam 15*a* of the operating mechanism 15 so that the safety switch 11 is pushingly operated.

A lock member 16 for restraining the rotation of the hooks 8 is fitted in the front end 12*b* of the safety switch operating lever 12. The lock member 16 is formed in an L shape having an arm 16*a* fitted in the safety switch operating lever 12, and a lock pin 16*b* extending from one end of the arm 16*a* in parallel with the safety switch operating lever 12 as slidably inserted in the side plate 13. When the lock member 16 is rearwardly moved together with the safety switch operating lever 12, the tip of the lock pin 16*b* is inserted in an engagement hole 8*b* in the front-side hook 8. This prevents the hooks 8 from being rotated. When the lock member 16 is forwardly moved together with the safety switch operating lever 12, the tip of the lock pin 16*b* is pulled out from the engagement hole 8*b* in the front-side hook 8. This permits the hooks 8 to be rotated. In this embodiment, the lock member 16 is attached to the safety switch operating lever 12. It is therefore possible to eliminate a member for supporting the lock member 16 and a member for forwardly moving the lock member 16. This not only simplifies the structure of the copying machine, but also lowers the cost thereof. When the front cover 7 is closed, the lock member 16 is directly pushed by a pushing portion 7*a* (See FIG. 2) projecting from the front cover 7, causing the lock member 16 to be rearwardly moved together with the safety switch operating lever 12.

Figure 2:
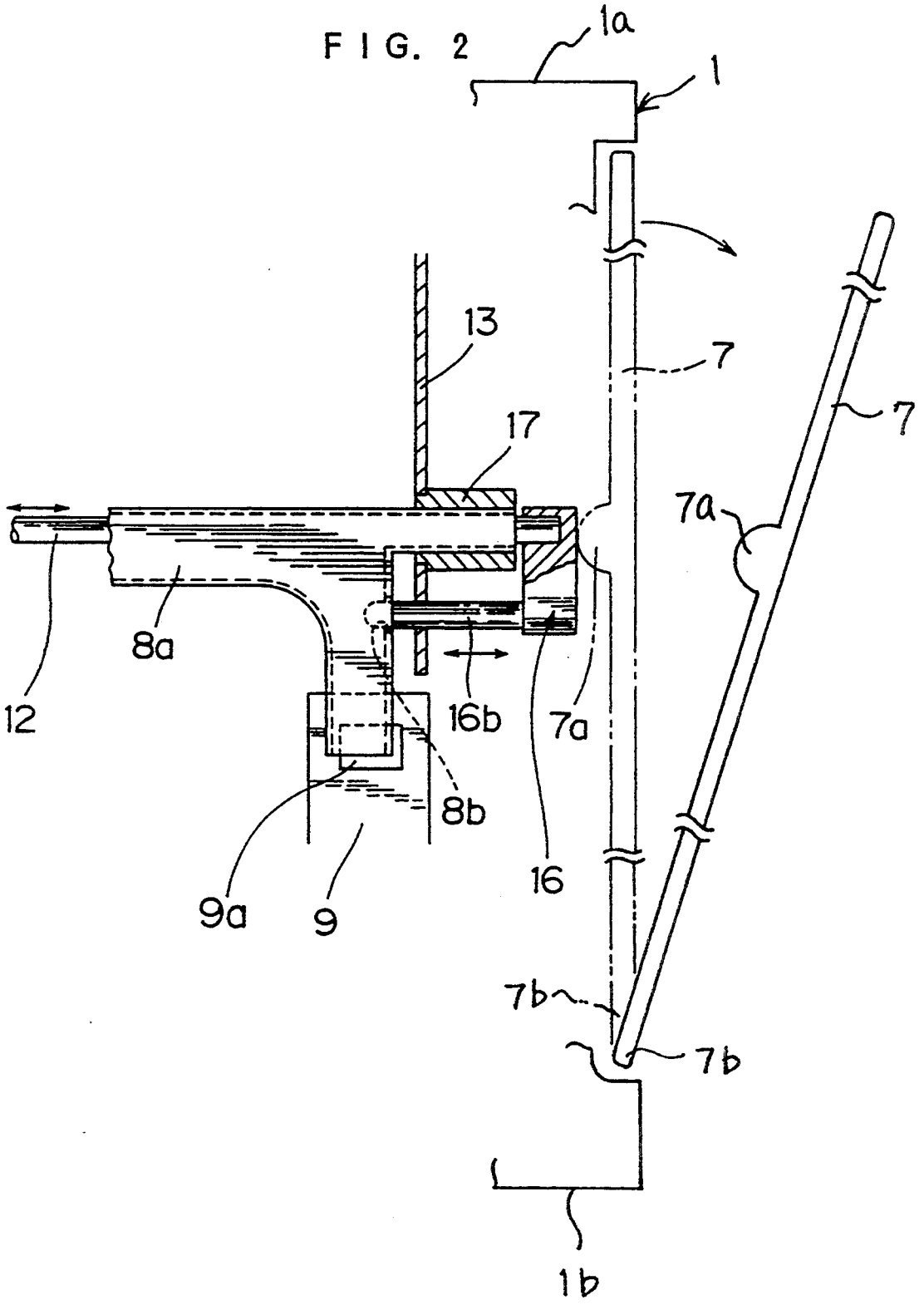
FIG. 2 is a section view of main portions of the embodiment shown in FIG. 1.

An operating lever 17 is rotatably fitted in the front-side plate 13 for rotatably operating the front-side hook 8 (See FIG. 2). The operating lever 17 is fitted to an engagement projection 8*c* extending along the safety switch operating lever 12 from the front-side hook 8. The operating lever 17 and the engagement projection 8c are integrally rotatable. The front end 12b of the safety switch operating lever 12 is supported by the plate 13 through the engagement projection 8c and the operating lever 17.

According to the arrangement above-mentioned, when the previously opened front cover 7 is closed by the operator with the hooks 8 engaged with the engagement members 9, the lock member 16 is pushed by the front cover 7 and rearwardly moved together with the safety switch operating lever 12. When the lock member 16 is rearwardly moved in such a manner, the lock pin 16b of the lock member 16 is introduced in the engagement hole 8b in the front-side hook 8, thus preventing the hooks 8 from being rotated. In this connection, there is no likelihood that the hooks 8 and the engagement members 9 are disengaged from each other, even though the copying machine is vibrated in the course of transportation or the like thereof. This prevents the upper unit 1a from being unexpectedly opened.

When the front cover 7 is opened by the operator for a paper jam processing or the like, the compression spring 12c causes the lock member 16 together with the safety switch operating lever 12 to be forwardly moved. When the lock member 16 is forwardly moved in such a manner, the lock pin 16b of the lock member 16 is pulled out from the engagement hole 8b in the front-side hook 8. This allows the hooks 8 to be rotated, thus enabling the upper unit 1a to be opened.

As discussed in the foregoing, the rotation of the hooks 8 can be prevented/allowed in association with the opening/closing operation of the front cover 7. It is therefore possible to prevent the upper unit 1a from being unexpectedly opened with no special operation required for allowing the rotation of the hooks 8. Further, the lock member 16 can be repeatedly used. Accordingly, even after the copying machine has been installed at a predetermined position, it is possible to prevent the upper unit 1a from being unexpectedly opened.

In the embodiment above-mentioned, the lock member 16 is shown as attached to the safety switch operating lever 12. However, it is a matter of course that the lock member 16 may be disposed independently from the safety switch operating lever 12.

The present invention can be modified in design in a variety of ways. For example, the lower unit 1b may have the hooks 8 while the upper unit 1a may have the engagement members 9.

What is claimed is:

1. An image forming apparatus of the clamshell type in which an upper unit of said image forming apparatus is rotatably openably connected to a lower unit of said image forming apparatus, and in which the upper unit is biased in an opening direction by a biasing member and in which a rotatably openable front cover is disposed at a front portion of the upper and lower units, comprising:

a hook disposed at one of said upper and lower units and adapted to be rotatably operated around an axis parallel to an axis of rotation of said upper unit;

an engagement member disposed at an opposite one of said upper and lower units such that said engagement member is adapted to be engaged with said hook, thus preventing said upper unit from being opened;

a spring for biasing said hook in such a direction that said hook is engaged with said engagement member; and a lock member so disposed as to be reciprocated along an axis parallel to the axis of rotation of said hook, said lock member being adapted to restrain the rotation of said hook engaged with said engagement member when said lock member is moved in a first direction in association with a closing operation of said front cover, and adapted to allow for rotation of said hook when said lock member is moved in a second direction in association with an opening operation of said front cover.

2. An image forming apparatus according to claim 1, wherein said lock member is attached to a safety switch operating lever adapted to be reciprocated along the axis of rotation of said hook in association with the opening/closing operation of the front cover.

3. An image forming apparatus according to claim 1, further comprising a hook assembly comprising said hook, a second hook and a member integrally rotatably connecting both of said hooks, and wherein said hooks are disposed at each of two positions of said image forming apparatus at forward and rearward sides thereof, and said lock member is adapted to be engaged with at least one of said hooks to prevent said hooks from being rotated.

4. An image forming apparatus according to claim 2, wherein said hook is attached to said safety switch operating lever.

5. An image forming apparatus according to claim 1, wherein said lock member includes a lock pin to be engaged with said hook.

* * * * *